US007311562B2

(12) United States Patent
Leong et al.

(10) Patent No.: US 7,311,562 B2
(45) Date of Patent: Dec. 25, 2007

(54) PREVENTING DAMAGE TO RJ JACKS FROM IMPROPER PLUG INSERTION

(75) Inventors: Kuok Sang Leong, Kowloon (HK); Wai Shun Leung, Kowloon (HK)

(73) Assignee: Bel-Fuse, Inc., Jersey City, NJ (US)

( * ) Notice: Subject to any disclaimer, the term of this patent is extended or adjusted under 35 U.S.C. 154(b) by 0 days.

(21) Appl. No.: 11/014,277

(22) Filed: Dec. 16, 2004

(65) Prior Publication Data

US 2005/0191909 A1 Sep. 1, 2005

Related U.S. Application Data

(60) Provisional application No. 60/530,450, filed on Dec. 16, 2003.

(51) Int. Cl.
*H01R 24/00* (2006.01)

(52) U.S. Cl. ..... 439/767

(58) Field of Classification Search ..... 439/676, 439/677, 680, 218, 344
See application file for complete search history.

(56) References Cited

U.S. PATENT DOCUMENTS

| | | | | |
|---|---|---|---|---|
| 6,146,209 | A * | 11/2000 | Francis | 439/676 |
| 6,220,900 | B1 * | 4/2001 | Huang | 439/676 |
| 6,283,796 | B1 * | 9/2001 | Yeh | 439/677 |
| 6,315,618 | B1 * | 11/2001 | Francis | 439/676 |
| 6,319,070 | B1 * | 11/2001 | Tan | 439/680 |
| 6,368,160 | B2 * | 4/2002 | Chang | 439/676 |
| 6,375,516 | B1 * | 4/2002 | Trinh | 439/680 |
| 6,431,919 | B1 * | 8/2002 | Wang et al. | 439/680 |
| 2002/0009930 | A1 * | 1/2002 | Chang | 439/677 |
| 2003/0129880 | A1 * | 7/2003 | Arnett et al. | 439/676 |

* cited by examiner

*Primary Examiner*—Tulsidas C. Patel
*Assistant Examiner*—Harshad C Patel
(74) *Attorney, Agent, or Firm*—Ostrolenk, Faber, Gerb & Soffen, LLP

(57) ABSTRACT

An RJ-45 jack having a groove to accommodate the width of an RJ-11 plug to allow the plug to rise upward and away from the outer contacts of the RJ-45 contacts upon inadvertent insertion of an RJ-11 plug into the RJ-45 jack.

3 Claims, 3 Drawing Sheets

PREVENTING DAMAGE TO RJ JACKS FROM IMPROPER PLUG INSERTION

CROSS REFERENCE TO RELATED APPLICATIONS

This application is based on and claims priority to Provisional Application Ser. No. 60/530,450, filed Dec. 16, 2003 and entitled "RJ11 DAMAGE PREVENTION SCHEME FOR RJ45 JACK," the entire disclosure of which is incorporated hereby by reference.

BACKGROUND OF THE INVENTION

The present invention relates to RJ jacks having means for preventing damage to the contacts of the jacks from insertion of non-complementary plugs and, more particularly, to RJ45 jacks having means for preventing damage to the contacts of the RJ45 jacks from insertion of RJ11 plugs.

An RJ11 connector comprises a six-contact plug and corresponding jack commonly used to connect a communications device such as a telephone, facsimile machine or modem to a telephone line. An RJ45 connector, which is somewhat wider than the RJ11 connector includes eight contacts and is commonly used for Ethernet local area network (LAN) connections.

Referring to FIGS. 1A and 1B there are shown diagrammatic bottom and elevation views, respectively, of an RJ11 plug 10, and referring to FIGS. 2A and 2B there are shown diagrammatic bottom and elevation views, respectively, of an RJ45 jack 12 in insertion alignment with the RJ11 plug of FIGS. 1A and 1B, with FIG. 2A only showing the contact fingers 14 of the RJ45 jack 12. The RJ11 plug 10 includes six contact fingers 16 for mating with six contact fingers of an RJ11 jack (not shown). The RJ45 jack 12 includes a housing 18 having an interior chamber 20 with an opening through the front wall through which an RJ45 plug 22 (FIG. 3) may be received into the interior chamber 20. Eight resilient contact fingers 14 are arranged in the chamber 20. The spacing between the jack contact fingers 14 is equal to the spacing of corresponding contacts 26 in the RJ45 plug 22 (FIG. 3).

RJ11 and RJ45 receptacles are often found close to one another, for example, as side-by-side wall jacks in office or other commercial or industrial environments, on computers, on adapters, etc. This proximity can lead to damage to the contacts of the RJ45 jacks.

This is because the RJ11 and RJ45 designs are dimensionally similar, allowing the smaller RJ11 to feign proper mating without any tactile sense of the connection being forced. The results of this all-too-common error are at least damaging and can totally destroy a jack's electrical integrity by permanently crushing its outermost contact fingers.

The root of the problem is that the RJ11 plug is essentially a narrower, six contact version of the eight contact RJ45. Engagement dimensions and contact pitch are common to both. However, the narrower contact region of the RJ11 plug places its body's wide sidewalls 24 (FIG. 1A) directly in line with the outboard contacts 14*a* and 14*h* of the RJ45 jack 12 (FIG. 2A). These contacts 14*a* and 14*h* are designed to hook into relief slots on a mating plug, so the solid sidewalls 24 of the RJ11 tend to crush them during a mating attempt.

Contact force between plug contacts and jack fingers of RJ series connectors is generated by deflecting the inclined, cantilevered, spring fingers of the jack downward as a plug is inserted. For a plug to produce this force, it must enter the jack along a line of action parallel to the planes of the jack's floor and top. Further, the overall height of the plug's body must be only slightly less than the distance between the jack's top and floor so that the top surface of the plug is able to bed against the roof of the jack, thereby insuring that the contacts maintain a fixed height above the jack floor as the upwardly directed force of the fingers grows to more than 100 gms per contact during mating.

As seen in FIG. 3, the contacts 26 of an RJ45 plug 22 are recessed in grooves 28 that keep them typically 0.020" above the base plane of the plug's shell. As shown in FIG. 3, so long as each contact 26 coincides with its corresponding groove 28, proper mating geometry is maintained. However, if, as seen in FIG. 4, a narrower RJ11 plug 10 is pushed into an RJ45 jack opening 20, no contact grooves 28 are presented to receive the outermost fingers 14*a* and 14*h* of the RJ45 jack 12; instead, the shoulders 24 of the RJ11 plug 10 engage the outer fingers 14*a*, 14*h* and, as a result, the fingers are driven down close to the plane of the jack's floor, permanently deforming them.

As used herein, the term "complementary plug" means a plug of the same RJ series as an RJ jack and the term "non-complementary plug" means a plug of a different RJ series than an RJ jack.

SUMMARY OF THE INVENTION

It is an object of the present invention to prevent damage to the contacts of RJ jacks from insertion of non-complementary RJ plugs.

The foregoing and other objects are achieved in accordance with certain features of the invention by an RJ jack comprising a housing having a chamber for receiving a complementary plug; and a plurality of resilient contacts in the chamber. The chamber has a ceiling with a groove therein, the groove having a width substantially equal to the width of a non-complementary plug and the resilient force of the contacts upon insertion of a non-complementary plug causing the non-complementary plug to enter the groove.

Other features and advantages of the present invention will become apparent from the following description of the invention which refers to the accompanying drawings.

DETAILED DESCRIPTION OF PREFERRED EMBODIMENTS OF THE INVENTION

Figure 1A:
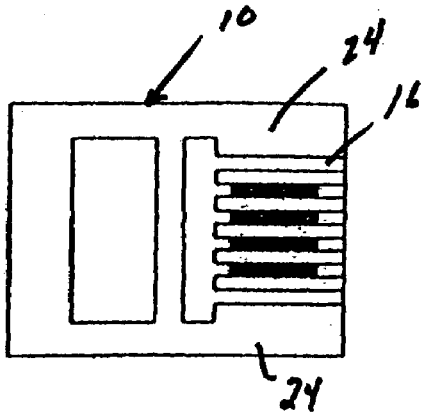
FIG. 1A PRIOR ART
FIGS. 1A and 1B are diagrammatic bottom and elevation views, respectively, of an RJ-11 plug.
Figure 2A:
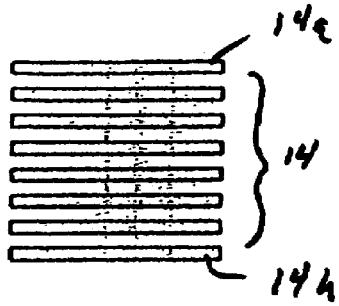
FIG. 2A PRIOR ART
FIGS. 2A and 2B are diagrammatic bottom and elevation views, respectively, of an RJ-45 jack in insertion alignment with the RJ-11 plug of FIGS. 1A and 1B, with FIG. 2A only showing the contacts of the RJ-45 jack.
Figure 1B:
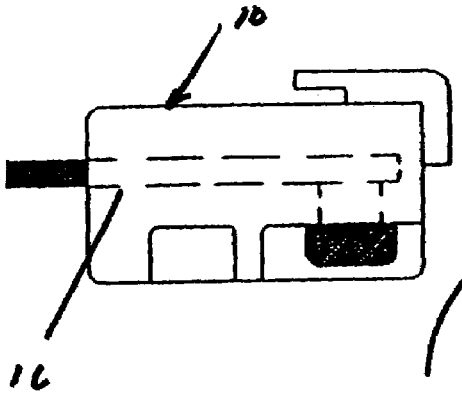
FIG. 1B PRIOR ART
Figure 2B:
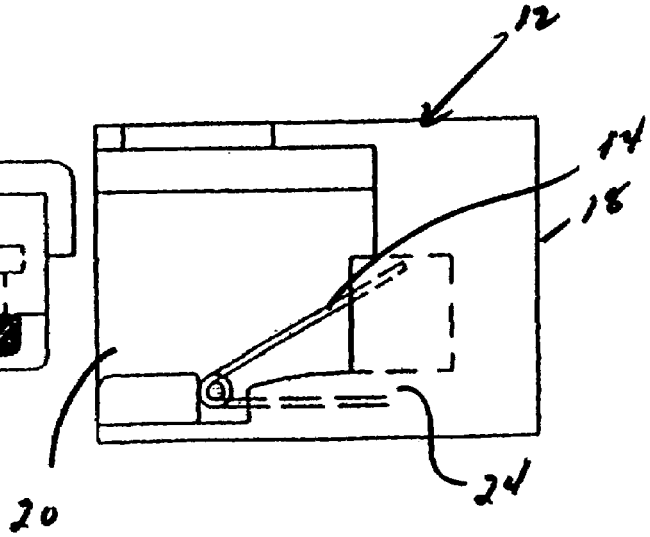
FIG. 2B PRIOR ART
Figure 3:
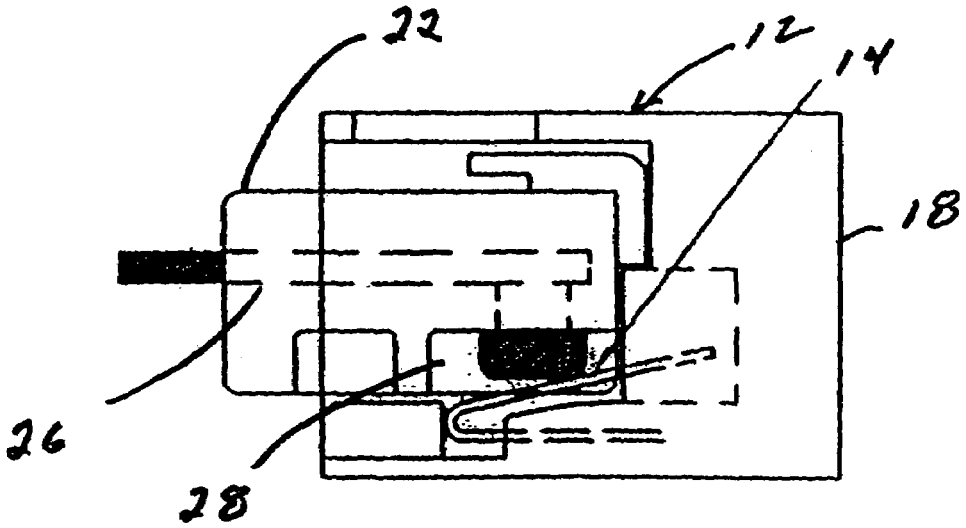
FIG 3 PRIOR ART
FIG. 3 is a diagrammatic elevation view of an RJ 45 plug inserted into an RJ-45 jack.
Figure 4:
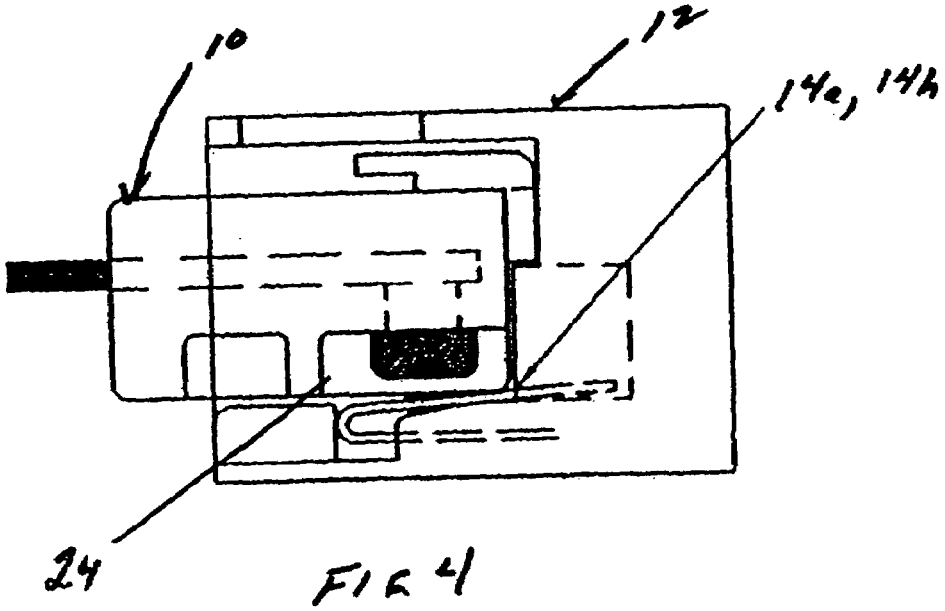
FIG 4 PRIOR ART
FIG. 4 is a diagrammatic elevation view of an RJ-11 plug inserted into an RJ-45 jack.
Figure 5B:
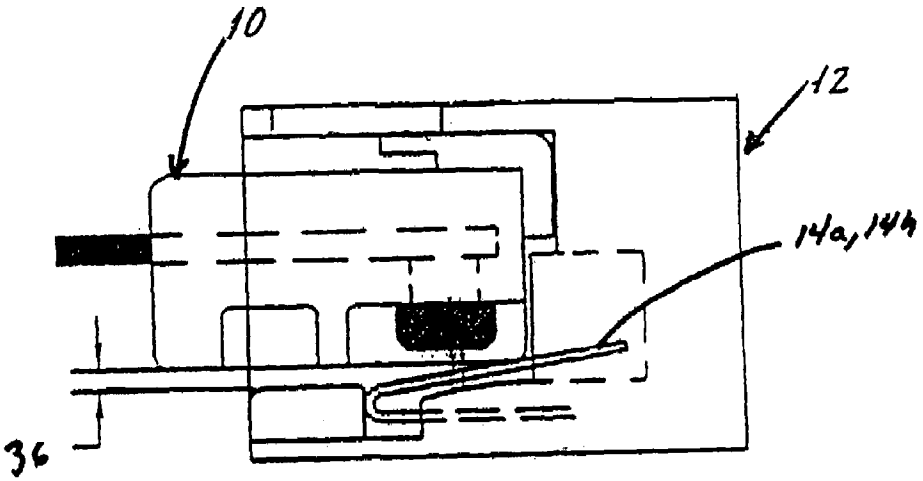
FIGS. 5A and 5B are diagrammatic front and side elevation views of an RJ-45 jack having means in accordance with certain features of the present invention for preventing damage to the contacts of the RJ-45 jack upon the attempted insertion of an RJ-11 plug.
Figure 5A:
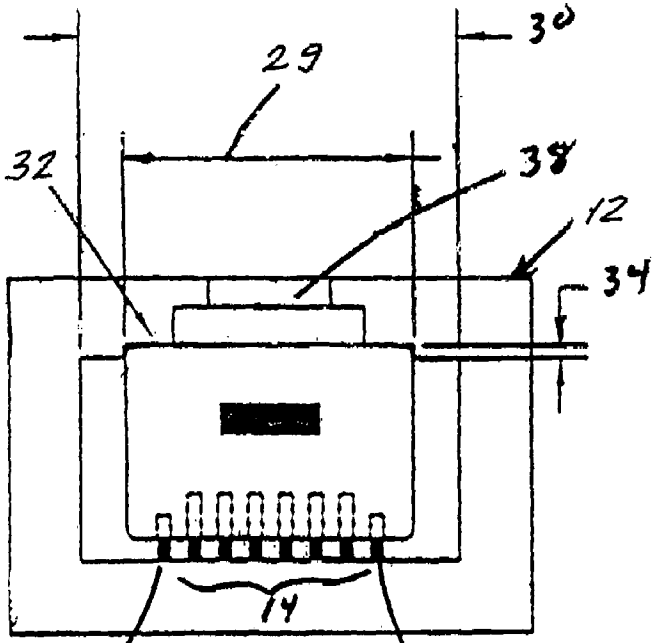

This invention takes advantage of the fact that the overall width 29 of the RJ11 plug 10 is significantly less the width 30 of the RJ45 plug 12. As seen in FIGS. 5A and 5B, by adding a relief groove 32, situate at the center of the top face of the RJ45 jack 12, and having a width slightly larger than that of the RJ11 plug 10, any such plug will be deflected upward into this channel formed by the additional relief 34 by the force of the jack's fingers 14 during insertion, providing increased bottom clearance 36 sufficient to prevent damage to the two threatened fingers. This can be clearly seen by comparing FIG. 5B to FIG. 4.

Conversely, since the width of the relief groove in the top closely corresponds to that of an RJ11 plug, enough surface contact area remains along its sides to properly interface with the "shoulders" of the wider, RJ45 style plug, leaving normal mating geometry unaltered.

Lastly, since the locking tab dimensions of the two plug types are essentially identical, the locking tab receiver slot 38 in the jack's top tends to keep the narrower RJ11 centered, thereby assuring adequate alignment should an insertion attempt be made.

Except for the modifications described herein, the RJ-11 plug and the RJ-45 jack are conventional. Examples of conventional RJ plugs and jacks may be found in U.S. Pat. Nos. 4,978,317, 5,283,796, 5,319,070, 6,319,070, 6,368,160, 6,375,516, 6,425,781 and U.S. Publication No. 2002/0009930.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An RJ jack, comprising:

a housing having a chamber for receiving a complementary plug; and a plurality of resilient contacts in the chamber, the chamber having a ceiling with a groove therein, the groove having a width substantially equal to the width of a non-complementary plug, the resilient force of the contacts upon insertion of the non-complementary plug causing the non-complementary plug to enter the groove.

2. An RJ-45 jack, comprising:

a housing having a chamber for receiving an RJ-45 plug; and a plurality of resilient contacts in the chamber, the chamber having a ceiling with a groove therein, the groove having a width substantially equal to the width of an RJ-11, the resilient force of the contacts upon insertion of an RJ-11 plug causing the RJ-11 plug to enter the groove.

3. An RJ45 jack as in claim 2, wherein the housing has an opening for receiving a locking tab of the RJ11 plug, the opening being centrally located in the groove so that if, the RJ11 plug is inserted into the chamber of the RJ45 jack, the RJ11 plug is centered within the groove.

* * * * *